US005349891A

United States Patent [19]

Belli

[11] Patent Number: 5,349,891

[45] Date of Patent: Sep. 27, 1994

[54] CONVERTIBLE DRUMHEAD

[75] Inventor: Remo D. Belli, North Hollywood, Calif.

[73] Assignee: Remo, Inc., North Hollywood, Calif.

[21] Appl. No.: 94,983

[22] Filed: Jul. 22, 1993

Related U.S. Application Data

[63] Continuation-in-part of Ser. No. 35,049, Mar. 22, 1993, abandoned.

[51] Int. Cl.[5] ..... G10D 13/02

[52] U.S. Cl. ..... 84/411 R; 84/418

[58] Field of Search ..... 84/411 R, 418, 411 A

[56] References Cited

U.S. PATENT DOCUMENTS 4,330,124 5/1982 Vettorello ..... 84/418 X 4,475,434 10/1984 Willis ..... 84/411 R

*Primary Examiner*—Michael L. Gellner

*Assistant Examiner*—Patrick J. Stanzione

*Attorney, Agent, or Firm*—Rapkin, Gitlin & Moser

[57] ABSTRACT

A convertible drumhead easily mounted and tensioned on a conga shell, adaptable for use with any conventional drum shell and usable independently as a single headed hand held drum that is uniform in construction and comprises a drumming surface, a circumferential side wall integrally formed with and disposed around the periphery of the drumming surface and an annular shoulder, which includes a seat portion along its top surface. The sidewall and the annular shoulder can be fashioned as a one-piece unit or as separate pieces where the shoulder is fixed in abutting relationship against the side wall. The invention is used in combination with a ring or a modified version of a standard rim mounted counter-hoop, which abuts against the side wall and is supported tightly upon the seat of the annular shoulder. The shoulder, when employed as a separate component, securely anchors itself to the side wall and, thus, will integrate with it to ensure the integrity of the drumhead. In doing so, the shoulder will withstand the stress forces that it normally experiences during the tensioning process to prevent its separation from the side wall.

13 Claims, 3 Drawing Sheets

FIG. 4
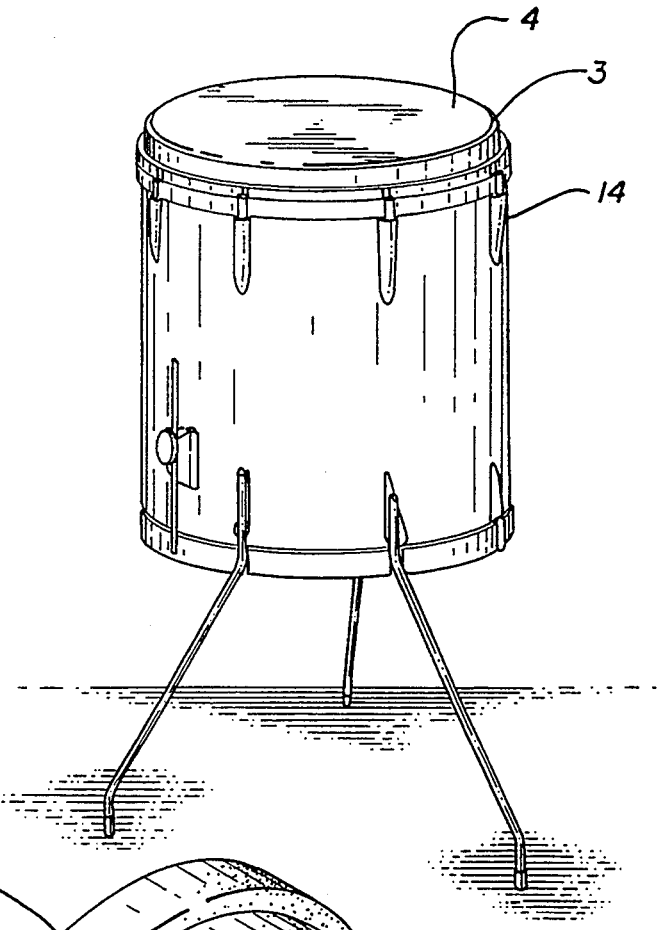
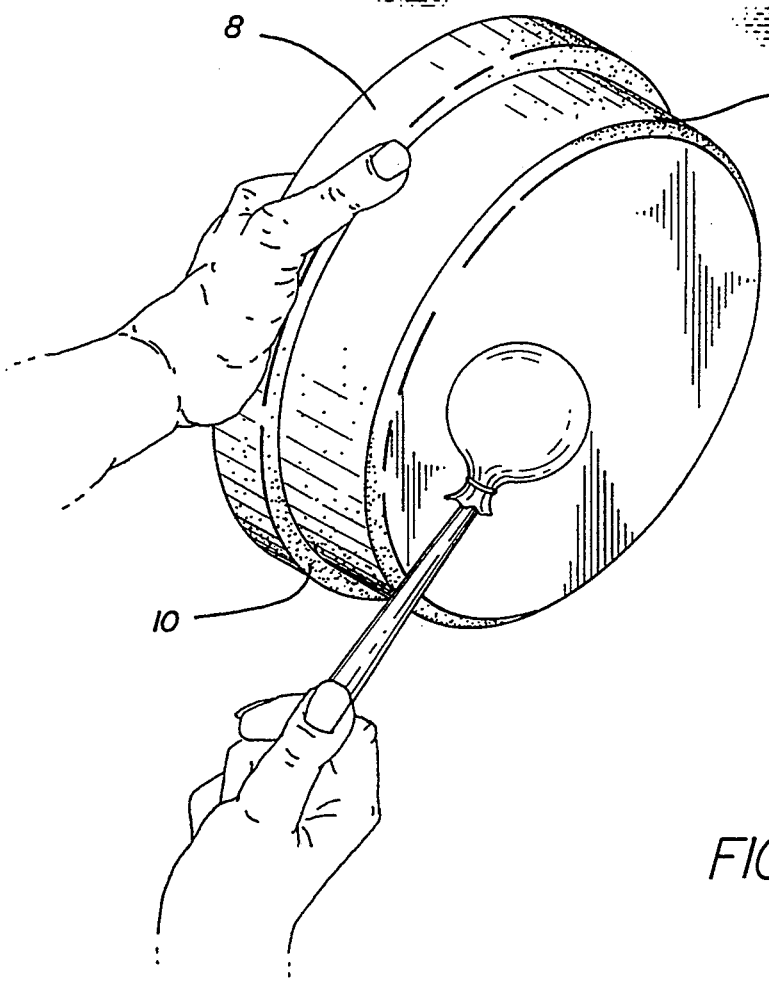
FIG. 5

CONVERTIBLE DRUMHEAD

This is a continuation-in-part of copending application Ser. No. 08/035,049 filed on Mar. 22, 1993, now abandoned.

BACKGROUND OF THE INVENTION

1. Field of the Invention

The present invention relates to the field of drums and drumheads and, more particularly to a convertible drumhead that is installable on a conga or any conventional drum shell utilizing an annular tensioning hoop mounted peripherally below the drumhead surface, and can be played as a single headed hand held instrument.

2. Description of the Prior Art

Drumheads used in combination with various types of drum shells have long been known in the art. Examples are heads which range from the relatively crude and unsophisticated, such as those using an animal skin stretched over the opening at one end of a drum shell, to the more sophisticated and conventional, such as those which employ the vastly improved synthetic materials from which many contemporary pretuned and non-pretuned drumheads are fashioned.

Congas, in contrast to the more familiar tom-toms, snare and bass drums that are used so often today in many contemporary bands and orchestras, enlist a special kind of head construction and tensioning mechanism. Generally, the head of a conga drum is constructed by first creating a flesh hoop, which is normally formed by wrapping an animal skin around the edges of a large ring and securing the skin to the ring by tucking it under the ring or by using any other appropriate means of attachment. The flesh hoop is then stretched over the opening at the top of the conga drum shell and secured and tensioned there with a counter-hoop in combination with any suitable tensioning mechanism. Alternatively, the animal skin can be stretched over the top end of a drum shell and then nailed in place with a series of tacks evenly distributed around the shell. Years ago, counter-hoops were fashioned from relatively crude materials that might have included a bendable tree branch, a braided or twisted rope or some similar item used for this purpose. Modern day versions of the counter-hoop are generally made of metal or occasionally a hard plastic material that is capable of withstanding the rigors and stress of the tensioning process.

To position a conga drum counter-hoop properly, the device is guided over the top of the drumhead until it eventually comes to rest upon the ring component of the flesh hoop. There, using, for example, any rope-like material, intertwisted strands of fibre or leather cord to connect the counter-hoop to the drum shell, the counter-hoop is drawn tightly in a downward direction stretching the flesh hoop to create a taut head to serve as a striking surface for the drum. Appropriate adjustments to the flesh hoop will then tension the head to achieve the desired tonality.

Counter-hoops used in conjunction with conga drums must, by necessity, be situated and secured to the shell below the actual head surface. A conga drummer plays the instrument by repeatedly striking the head with portions of the hands and fingers to create a pleasing rhythmic sound. Since the playing surface extends to the extreme perimeter or rim portion of the head, that area must remain totally unobstructed. Not only will this ensure that the drum will be played properly, but also that, in the process, the hands and fingers will avoid pain or possible serious injury that could result from repeatedly striking forcefully a metal counter-hoop jutting out above the drumhead surface.

Conga drumheads today are generally constructed either of a resilient paper, paper-like or economical synthetic product, which is used to manufacture inexpensive instruments considered usually to be no more than toys or, as explained previously, of an animal skin or some of the more expensive and resilient synthetic materials stretched tightly across the top of the drum shell used mostly with sophisticated instruments that are intended for serious musicians. Traditionally, neither type of head is pretuned.

When the head of an inexpensive or toy-like conga drum becomes damaged or worn, the entire drum is usually replaced. For economical reasons, repairing an instrument of this kind is normally not justified in these instances. In contrast, the professional head might require some minor repair occasionally, though replacement is preferred when the damage to the head is of a more serious nature. The installation and retuning of a seriously worn or defective professional type of conga drumhead is very often time consuming and a bit difficult to accomplish. The tensioning mechanism and the hoop first must be detached from the head. The head itself is then removed. Thereafter, the repaired or replaced head is saturated with water, then reattached to the shell and finally retuned after it completely dries using the counter-hoop and the tensioning mechanism to adjust the head to the desired tonality.

Conventional drums, such as tom-toms, snare drums and bass drums, also employ a counter-hoop, which is mounted on the rim of the head using any suitable clamping mechanism to ensure that the head is properly tensioned and tuned. The standard counter-hoop is typically comprised of metal and is round to conform to the shape of the head. The hoop is placed around the rim of the drumhead where it projects slightly above the head surface. The counter-hoop is fastened to the shell using a series of lugs tightly affixed and spread evenly around the exterior surface of the shell. Additionally, a corresponding series of rods connected at one end to the counter-hoop and to a mating lug at the other end are rotated to a prescribed tightness until the drumhead is appropriately tensioned and tuned to the proper tonality. Since the drum is played by repeatedly striking the approximate central portion of the head with one or more drum sticks, the upwardly projecting rim mounted counter-hoop will not normally interfere with the proper playing of the instrument or obstruct the sticks or hands in the playing process.

Accordingly, a conga drum head that utilizes a counter-hoop mounted below the drumhead surface is generally not compatible with a standard drum shell. Likewise, a drumhead using a rim mounted counter-hoop is generally not compatible with a conga shell.

Thus, it is desirable to provide a convertible drumhead for use with all types of pretuned and non-pretuned drums, including tom-toms, snare, bass, and conga drums, that can be played without the obstruction and inconvenience of a rim mounted counter-hoop, can withstand the stress forces associated with the tensioning process without disturbing the integrity of the instrument, can easily and quickly be installed and removed from the drum shell for repair or replacement and also can be played as a single headed hand held drum.

SUMMARY OF THE INVENTION

The present invention provides a pretuned or non-pretuned drumhead that can easily be installed and removed from almost any kind of instrument shell and, most importantly can be employed with that shell without the use of a standard rim mounted counter-hoop. The drumhead of the present invention is a convertible device that is easily mounted and tensioned on a conga shell, is adaptable for use with any conventional drum shell and also can be used independently as a single headed hand held drum. The drumhead is uniform in construction and comprises a drumming surface, a circumferential side wall integrally formed with and disposed around the periphery of the drumming surface and an annular shoulder, which includes a seat portion along its top surface. The sidewall and the annular shoulder can be fashioned as a one-piece unit or as separate pieces. If fashioned separately, the shoulder is fixed in abutting relationship against the side wall. The invention is used in combination with a ring or modified version of a standard rim mounted counter-hoop, which abuts against the side wall and is supported tightly upon the seat of the annular shoulder. The hoop is attached by using any conventional tensioning mechanism, including, for example, the lug and rod combination normally used to secure the head to the instrument shell and tighten the head to the desired tonality. The annular shoulder and the side wall cooperate to enable the shoulder, when employed as a separate component, to securely anchor itself to the wall and integrate with it. This ensures the integrity of the drumhead, and more specifically that the shoulder will withstand the stress forces that it will experience during the tensioning process and not separate from the side wall as a result. In the absence of a strong bond between these two critical components, the tension on the head will begin to fail resulting in a dramatic loss of proper tonality. The device then becomes worthless as an instrument.

The apparatus of the present invention is particularly suitable for use with a conga drum, which according to traditional design incorporates a drumhead with an unobstructed rim, i.e. without a rim mounted counter-hoop. The invention also can be employed with all types of conventional drums, such as toms and snares, and hand held single headed drums, where the side wall portion of the head is substantial enough in size and designed, and the shoulder exists, to enable the musician to hold and play it independently of the shell. With the hand held single headed type of drum, the drumhead is held so that the striking surface faces to the side. The annular shoulder fits snugly inside the palm of the drummer's hand while the drummer's thumb rests firmly against the annular seat to ensure a firm and comfortable grip.

Accordingly, it is an object of the present invention to provide an improved pretuned or non-pretuned drumhead that can easily and quickly be mounted on an instrument shell of any type without employing the use of a standard rim mounted counter-hoop.

It is a further object of the present invention to provide an improved pretuned or non-pretuned drumhead that includes an annular shoulder formed below the rim of the striking surface of the head for engaging a counter-hoop, which, used together with any suitable tensioning mechanism, acts to tension the head and secure it to the instrument shell.

It is yet another object of the present invention to provide an improved pretuned or non-pretuned drumhead having a circumferential side wall and an abutting annular shoulder that cooperate to enable the shoulder to securely anchor itself to the wall and prevent the components from separating.

It is yet another object of the present invention to provide an improved pretuned or non-pretuned drumhead having a circumferential side wall and an abutting annular shoulder that cooperate to ensure that the drumhead will withstand any damage arising from the stress forces normally associated with the tensioning process and the constant pounding of the drum sticks upon the striking surface.

It is a further object of the present invention to provide an improved pretuned or non-pretuned drumhead that can be held and played as a single headed drum in lieu of its use only as the striking surface of a more elaborate instrument shell.

It is yet another object of the present invention to provide an improved pretuned or non-pretuned drumhead having a circumferential side wall and an annular shoulder for grasping and holding the drumhead independently of the instrument shell as a single headed drum.

It is yet another object of the present invention to provide an improved pretuned or non-pretuned drumhead that does not require the use of a standard rim mounted counter-hoop and is interchangeably adaptable for use with both conga and conventional drums.

It is still yet another object of the present invention to provide an improved pretuned or non-pretuned drumhead that is easy and cost effective to manufacture.

Other objects and advantages of the present invention will become apparent in the following specifications when considered in light of the attached drawings wherein the preferred embodiment of the invention is illustrated.

BRIEF DESCRIPTION OF THE DRAWINGS

FIG. 4 is a perspective view of the present invention shown installed and tensioned on a conventional instrument shell.

FIG. 5 is a perspective view of a single headed drum embodiment of the present invention shown being played and held by a drummer.

DETAILED DESCRIPTION OF THE PREFERRED EMBODIMENT

Figure 1:
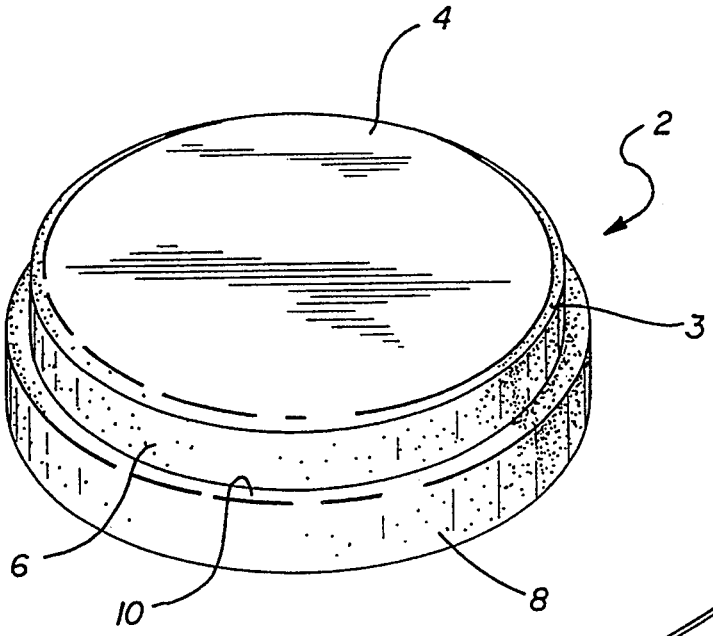
FIG. 1 is a perspective view of the present invention.
Figure 2:
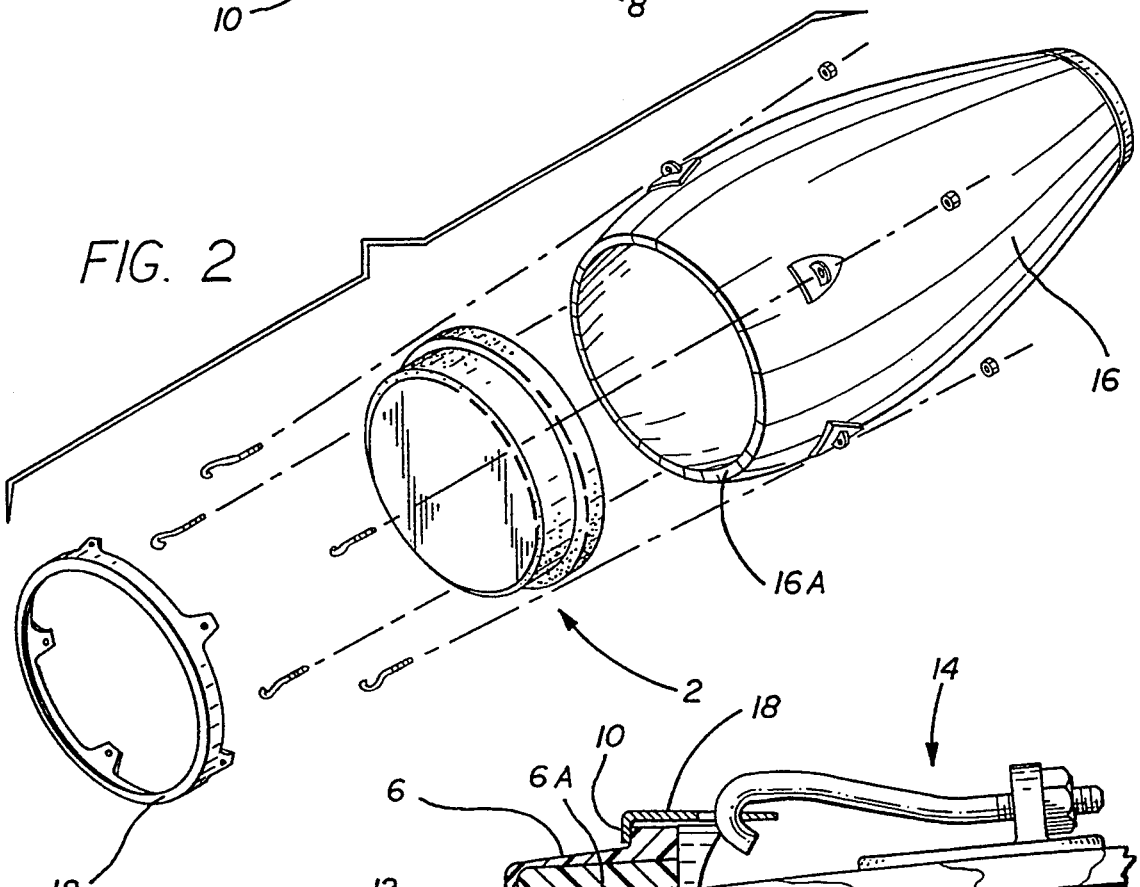
FIG. 2 is an exploded view of the present invention shown in relation to the tensioning mechanism and instrument shell.
Figure 3:
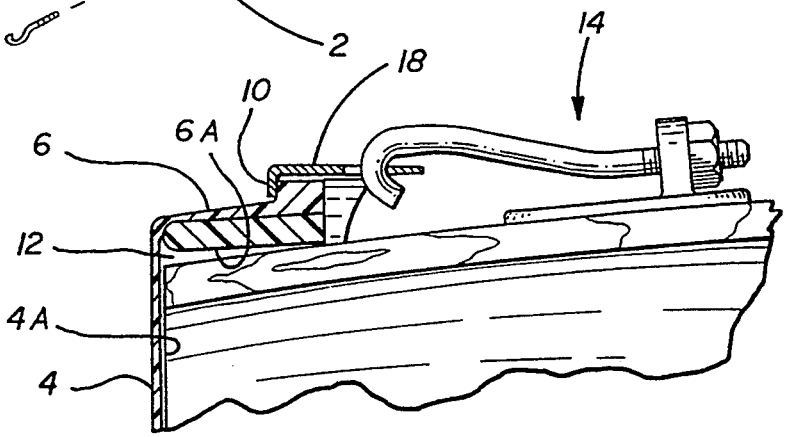
FIG. 3 is a sectional view of the present invention shown tensioned and secured to an instrumental shell.
Figure 6:
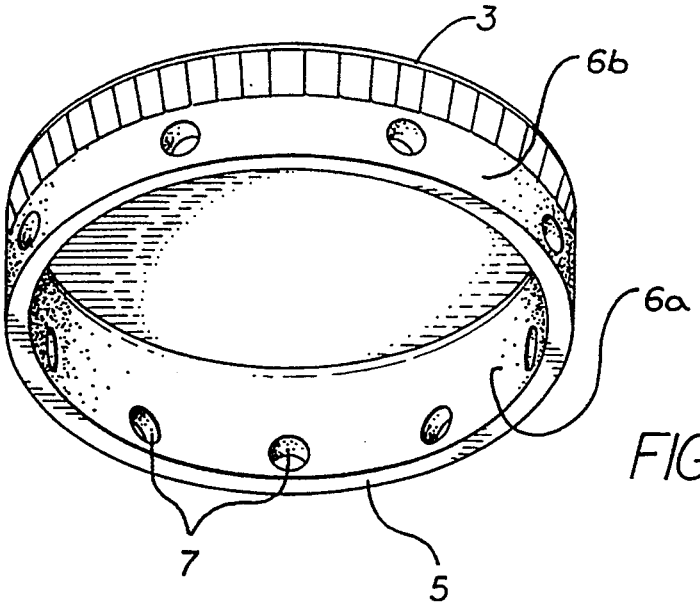
FIG. 6 is a perspective view of the present invention, partially in phantom, showing the plurality of spaced openings disposed around the peripheral side wall.
Figure 7:
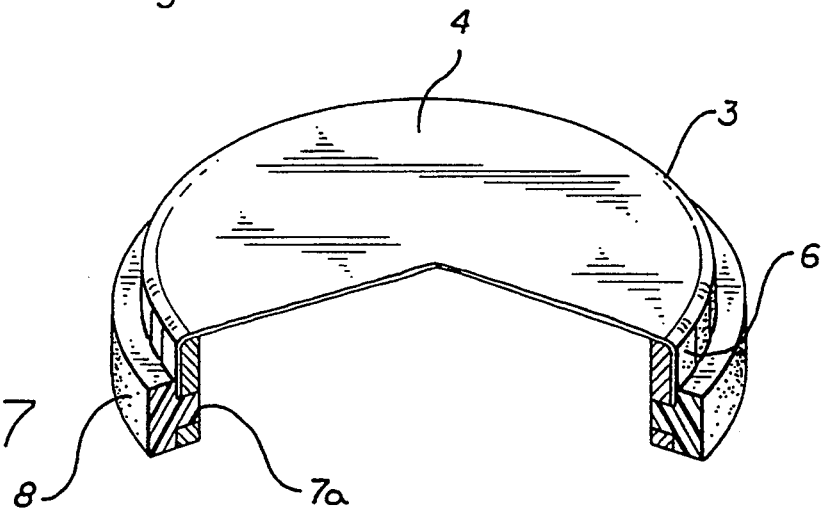
FIG. 7 is a sectional view of the present invention showing the annular shoulder anchored to the peripheral side wall.
Figure 8:
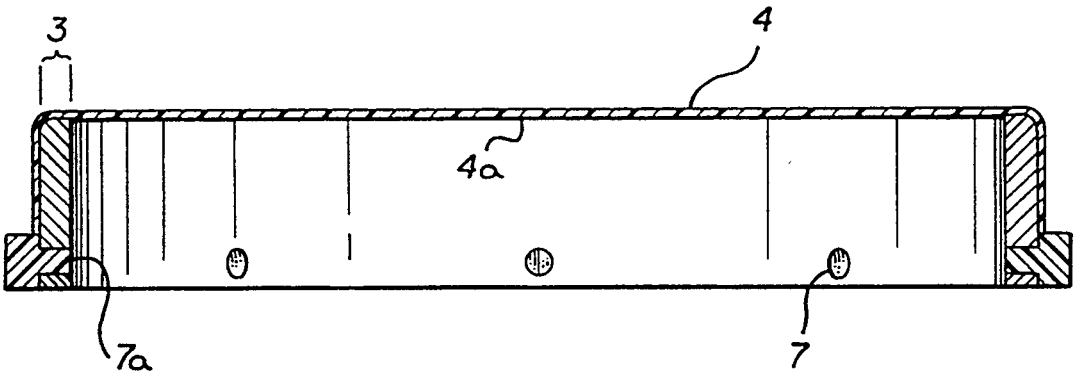
FIG. 8 is an elevational cross-section of the present invention.

FIG. 1 depicts a perspective view of the improved drumhead of the present invention designated generally as 2. Drumhead 2, which normally is pretuned, but which may also be non-pretuned, is comprised of a striking surface 4, an annular side wall 6 formed integrally therewith, an exposed annular top rim 3 that encompasses the top of said annular side wall 6 where the drum head 4 rests, and an annular shoulder 8 formed integrally with the side wall 6 as a one-piece component. Shoulder 8 includes an annular seat 10, which projects outwardly from the side wall 6. A cavity 12, which is formed beneath the striking surface 4, is defined by the inner surface 4*a* and the inner side wall 6*a*.

An alternative embodiment of the present invention combines a separate annular shoulder 8 with the side wall 6. The annular shoulder is formed as a single component from any suitable resin material using a conventional injection molding process. Disposed around the side wall 6, generally near the bottom rim 5, are a plurality of spaced openings 7 that penetrate entirely through the side wall 6 from the inner side wall 6*a* to the outer side wall 6*b*. A portion of the same pre-cured liquid resin that will ultimately form the annular shoulder 8 in its rigid state is caused to flow through each of the openings 7 completely filling each void in the process and forming therein a cured resin plug 7*a*. The resin that forms the shoulder also acts to seal it tightly to the side wall 6 when it cures. This, together with the resin plug 7*a* that fills each void, which act as individual little anchors in this capacity, combine to secure the shoulder to the side wall 6. The strong bond created as a result of this combined effort will preclude the shoulder 8 from separating from the side wall 6, an occurrence that would otherwise likely result from the stress forces caused by the regular tensioning of the instrument and the constant pounding of the sticks or hands upon the drumhead surface. Without the strong bond existing between these critical components, the tension in the head will begin to fail resulting in a dramatic, if not total, loss of proper tonality. As an instrument, the device will then become worthless.

In a typical application of the present invention, head 2 is placed over the top 16*a* of a conga drum shell 16. A counter-hoop 18 made of metal or some other suitably hard material is guided over the striking surface 4 and around the side wall 6 until it rests evenly on the annular seat 10. Using any suitable clamping or tensioning mechanism 14, such as a lug-claw hook or lug-clamp combination, the hoop 18 is engaged and the head 2 is secured to the shell 16. The tensioning mechanism is then adjusted to tune the head 2 to the desired tonality.

Because of its versatility, head 2 is adaptable for use with a conga drum shell, a standard drum shell and can also be hand held and played independently of a drum shell as a single headed drum. An example of the latter is demonstrated in FIG. 5, where the player is shown holding the head 2 in his left hand by grasping the shoulder 8 in the palm of his hand and the seat 10 by the thumb. The surface 4 is then struck with the drum stick held in the player's right hand.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

I claim:

1. In a combination with a drum shell having a circumferential side wall with a top rim and a bottom rim defined at opposite ends of said side wall, a musical instrument in the form of a convertible drumhead adapted to be installed in direct contacting engagement with or upon one or both of said rims, comprising a material for constituting a drumming surface having an exposed annular rim, said drumming surface and said annular rim being aligned along a common plane, a first circumferential wall having an exterior surface and an interior surface and a top section and a bottom section, said first circumferential wall formed generally normal to and integrally with the annular rim of the drumming surface, said drumming surface and said first circumferential wall combining to define a cavity with an opening at one end, an annular shoulder generally disposed circumferentially about the bottom section of said first circumferential wall comprising a second circumferential wall and a corresponding annular seat formed in a normal relation therewith and being adapted for use alternatively either as a hand grasp, when employing the instrument as a single-headed drum, or as a means to engage a mechanism for tensioning the drumhead and attach and secure the drumhead to the drum shell.

2. The invention of claim 1 wherein said means for tensioning the drumhead and to attach and secure the drumhead to a drum shell comprises an annular rigid band in conjunction with a lug and threaded rod combination tensioning mechanism.

3. The invention of claim 2 wherein said annular rigid band is comprised of metal.

4. The invention of claim 1 wherein the drumming surface is pre-tuned.

5. The invention of claim 1 wherein the drumming surface is non-pretuned.

6. A drumhead for use in conjunction with a drum shell wherein an annular hoop is employed in stressed relation with said drumhead for use in attaching and fixedly securing said drumhead to said drum shell and tensioning the drumhead to an appropriate tonality, comprising:

a material for constituting a drumming surface, a first supporting peripheral wall member having a top section, a bottom section, an inside surface and an outside surface, said first supporting peripheral wall member being integrally formed circumferentially with a drum surface with an orientation generally normal to said surface and having a plurality of spaced openings disposed generally around the bottom section, and a first liquid means curable to a rigid state comprising in said rigid state an annual shoulder disposed circumferentially and generally in abutting seal-tight relation against the outside surface of said first supporting peripheral wall member, said annular shoulder including means integrally formed therewith for fixedly anchoring said shoulder to said peripheral wall member to enable said shoulder to withstand the stress forces resulting from the tensioned engagement with said annular hoop.

7. The invention of claim 6 wherein said means integrally formed with said annular shoulder for fixedly anchoring said shoulder to said peripheral wall member comprise a second liquid means curable to a rigid state flowing from said first liquid means curable to a rigid state for engaging and filling each of the spaced openings.

8. The invention of claim 7 wherein said second liquid means comprise polyurethane material.

9. The invention of claim 7 wherein said second liquid means curable to a rigid state comprise a resin material.

10. A drumhead to be held by hand and played independently of a drum shell comprising, a material for constituting a drumming surface, a supporting peripheral wall member having a top section, a bottom section, an inside surface and an outside surface, said supporting peripheral wall member being integrally formed circumferentially of said drumming surface with an orientation generally normal to said surface and having a plurality of spaced openings disposed generally around the bottom section, a first means cured from a liquid to a rigid state comprising in said rigid state an annular shoulder protruding outwardly from said supporting peripheral wall member and disposed circumferentially and in abutting seal-tight relation against the outside surface of said supporting peripheral wall member, said annular shoulder including means integrally formed therewith for fixedly anchoring said annular shoulder to said supporting peripheral wall member, said annular shoulder having a horizontally extending top surface comprising an annular seat to engage and be gripped by a player's hand.

11. The invention of claim 10 wherein said means integrally formed with said annular shoulder for fixedly anchoring said shoulder to said supporting peripheral wall member comprise a second means cured from a liquid to a rigid state flowing from said first means cured from a liquid to a rigid state for engaging and filling each of the spaced openings.

12. In combination with a drum shell having a circumferential side wall with a top rim and a bottom rim defined at opposite ends of said side wall, a musical instrument in the form of a convertible drumhead adapted to be installed in direction contacting engagement with or upon one or both of said rims, comprising a material for constituting a drumming surface having an exposed annular top rim, said drumming surface and said exposed annular top rim being aligned along a common plane.

a peripheral wall member having a top section, a bottom section, an inside surface and an outside surface, said peripheral wall member having an orientation generally normal to the drumming surface and being integrally formed circumferentially thereof, and an annular shoulder disposed circumferentially and generally about the bottom section of said peripheral wall member, said annular shoulder adapted to engage a corresponding annular hoop means for use in attaching and fixedly securing said drumhead to a drum shell and tensioning the drumhead to an appropriate tonality.

13. A drumhead to be held by hand and played independently of a drum shell comprising, a material for constituting a drumming surface having an exposed annular top rim, said drumming surface and said exposed annular top rim being aligned along a common plane, a supporting peripheral wall member having a top section, a bottom section, an inside surface and an outside surface, said supporting peripheral wall member having an orientation generally normal to the drumming surface and being integrally formed circumferentially thereof, and an annular peripheral wall member protruding outwardly from said supporting peripheral wall member and disposed circumferentially and generally about the bottom section of said supporting peripheral wall member, said annular peripheral wall member having a horizontally extending top surface comprising an annular seat to engage the hand of and be held by a player.

* * * * *